US009101945B2

(12) United States Patent
Xu et al.

(10) Patent No.: US 9,101,945 B2
(45) Date of Patent: Aug. 11, 2015

(54) NOZZLE ASSEMBLY

(75) Inventors: Bo Xu, Shenzhen (CN); Wang-Kai Yuan, Shenzhen (CN); Rui-Gang Xie, Shenzhen (CN); Li-Feng Xue, Shenzhen (CN); Bin Zeng, Shenzhen (CN); Nian Zhang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 511 days.

(21) Appl. No.: 13/445,939

(22) Filed: Apr. 13, 2012

(65) Prior Publication Data

US 2013/0175359 A1 Jul. 11, 2013

(30) Foreign Application Priority Data

Jan. 10, 2012 (CN) ..... 2012 1 0005773

(51) Int. Cl.
*B05B 3/00* (2006.01)
*B05B 1/00* (2006.01)
*B05B 1/34* (2006.01)

(52) U.S. Cl.
CPC .. *B05B 1/005* (2013.01); *B05B 1/34* (2013.01)

(58) Field of Classification Search
CPC ..... B05B 3/00; B05B 1/34
USPC ..... 239/228, 518, 590, 590.3, 590.5, 504
See application file for complete search history.

(56) References Cited

U.S. PATENT DOCUMENTS

| | | | | | |
|---|---|---|---|---|---|
| 2,408,588 | A * | 10/1946 | Watts | 239/461 |
| 3,537,543 | A * | 11/1970 | Gibel | 181/258 |
| 4,815,664 | A * | 3/1989 | Tuthill et al. | 239/404 |
| 5,381,957 | A * | 1/1995 | Bianco | 239/99 |
| 6,095,436 | A * | 8/2000 | Seegers et al. | 239/403 |
| 6,247,656 | B1 * | 6/2001 | Wales et al. | 239/552 |
| 7,860,378 | B2 * | 12/2010 | Teraoka | 392/379 |
| 2003/0197073 | A1 * | 10/2003 | Bui | 239/463 |

* cited by examiner

*Primary Examiner* — Dinh Q Nguyen
*Assistant Examiner* — Joel Zhou
(74) *Attorney, Agent, or Firm* — Novak Druce Connolly Bove + Quigg LLP

(57) ABSTRACT

A nozzle assembly includes a support member, a first tube, a second tube, and a baffling member. The support member defines a receiving hole and an opening communicating with the receiving hole. The first tube extends through the opening and defines a first space communicating with the receiving hole. The second tube is retained within the receiving hole and defines a second space communicating with the receiving hole. The baffling member is securely connected to an end of the second tube that is retained within the receiving hole. The baffling member forms a plurality of gaps for directing the airflow from the first space.

6 Claims, 4 Drawing Sheets

NOZZLE ASSEMBLY

BACKGROUND

1. Technical Field

The present disclosure relates to nozzle assemblies and, particularly, to a nozzle assembly that can spray uniform airflow without turbulence.

2. Description of Related Art

Heat guns are always used to desolder electronic components from a printed circuit board (PCB). During the desoldering process, a nozzle assembly (nozzle) connected to an air compressor is usually used to direct airflow on an opposite side of the PCB, thereby dissipating heat of the electronic components on the opposite side of the PCB. Though conventional nozzle assemblies can satisfy basic requirements, a new type of nozzle assembly is still needed.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure are described with reference to the accompanying drawings.

Figure 1:
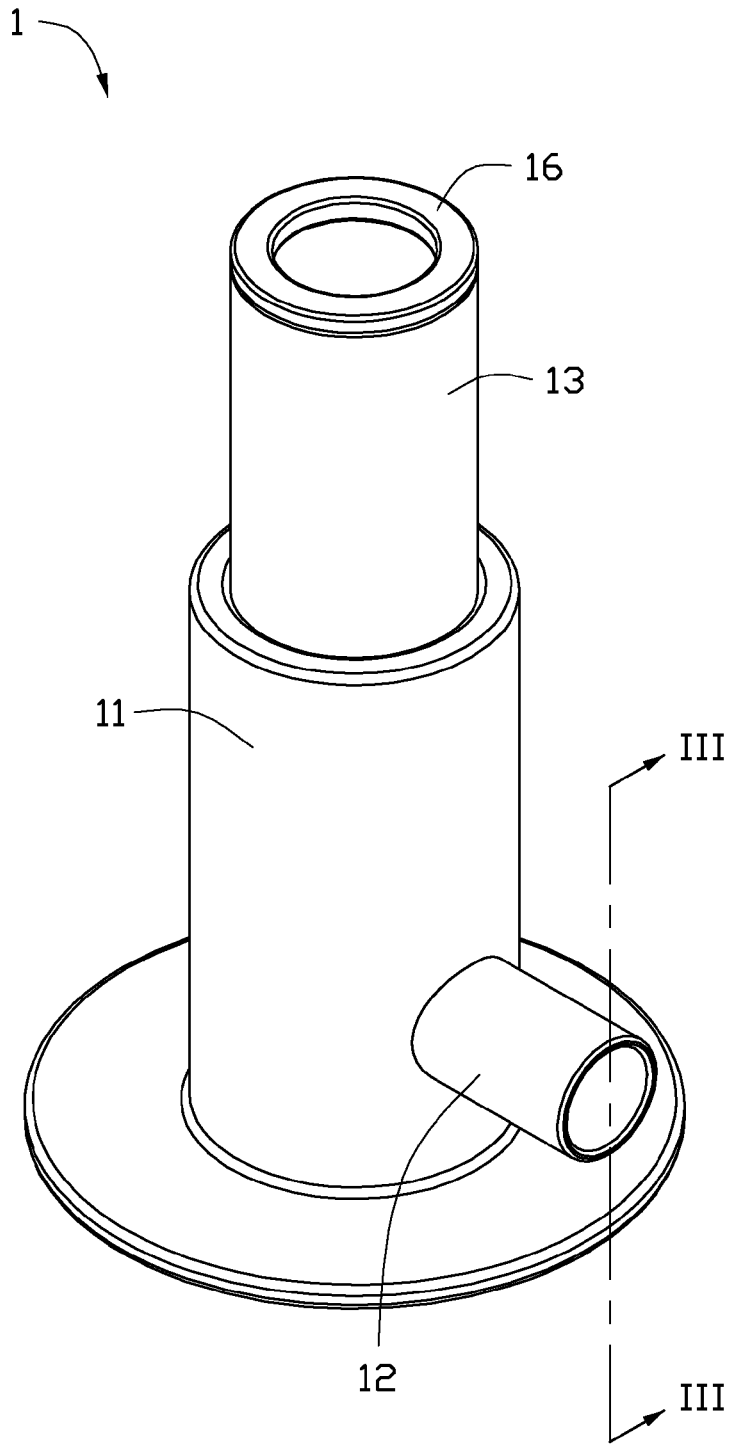
FIG. 1 is an isometric view of a nozzle assembly according to an exemplary embodiment.
Figure 2:
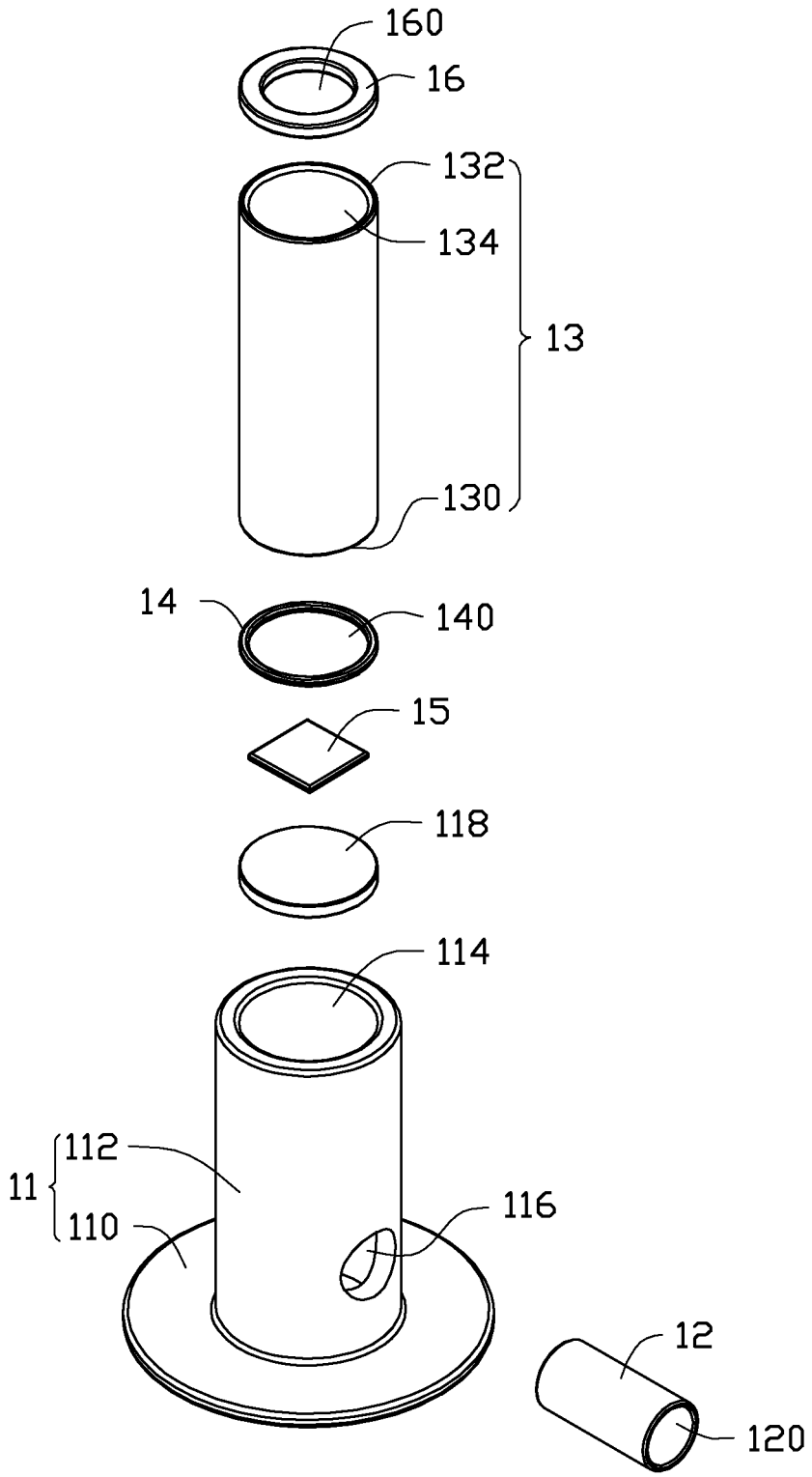
FIG. 2 is an exploded, isometric view of the nozzle assembly of FIG. 1.

Referring to FIGS. 1-2, a nozzle assembly 1 according to an exemplary embodiment is illustrated. The nozzle assembly 1 includes a support member 11, a first tube 12 defining a first space 120, a second tube 13 defining a second space 134, and a baffling member 15. The baffling member 15 forms a number of gaps A for directing the airflow from the first space 120. Thus, the second tube 13 can spray uniform airflow without turbulence.

The support member 11 includes a base 110 and a tube 112 perpendicular to the base 110. The base 110 is a round plate and the diameter of the base 110 is greater than that of the tube 112. The tube 112 defines a longitudinal receiving hole 114 and a mounting opening 116 located in a wall thereof and communicating with the receiving hole 114. The support member 11 further includes a magnet 118 located at the bottom of the receiving hole 114. The magnet 118 is used to apply an attractive force so as to attach the support member 11 to a magnetic member (not shown).

Figure 3:
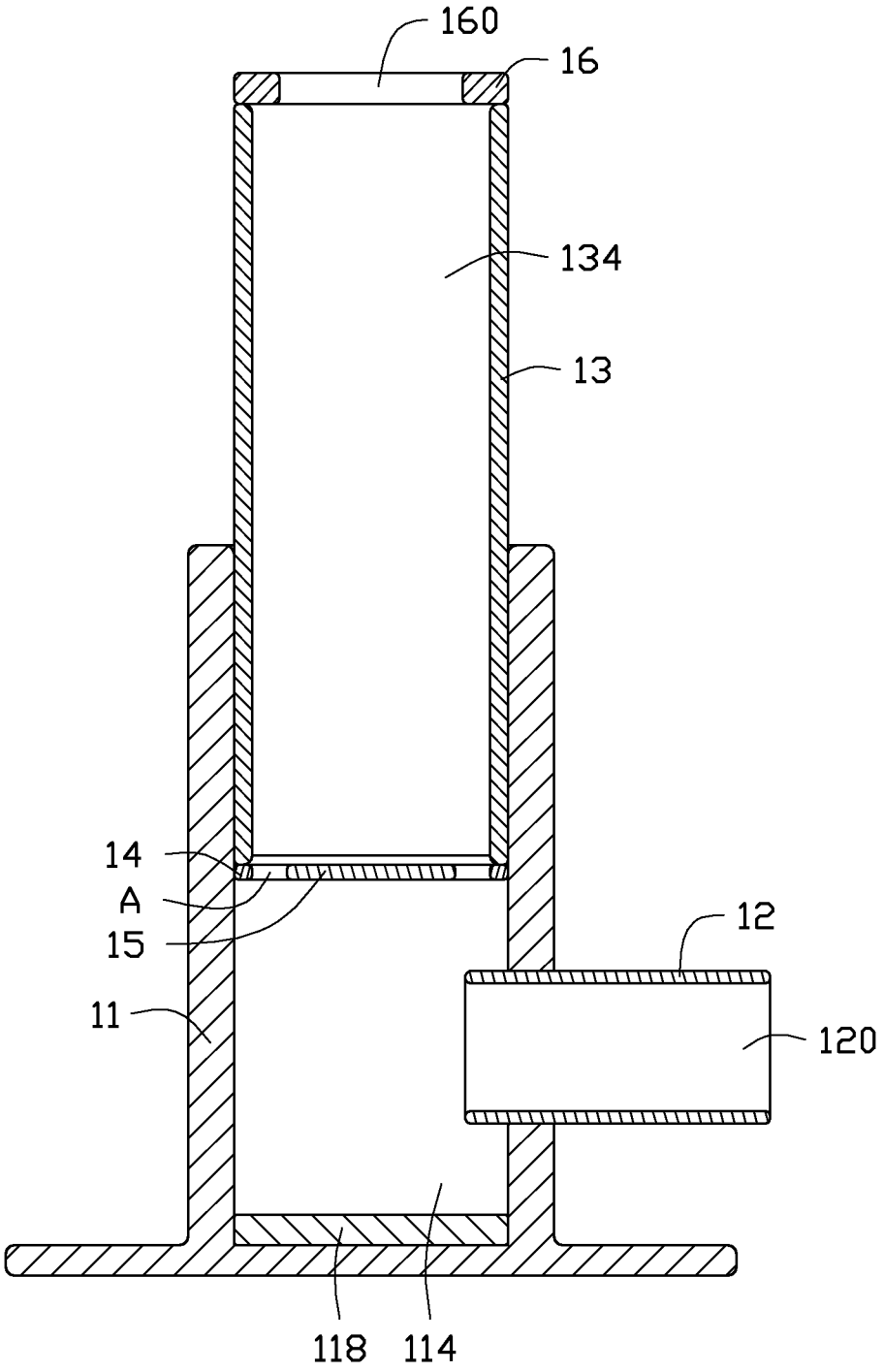
FIG. 3 is a cross-sectional view of the nozzle assembly, taken along line III-III of FIG. 1.

Referring also to FIG. 3, the first tube 12 extends through the opening 116 of the support member 11, and the first space 120 communicates with the receiving hole 114 of the support member 11.

The second tube 13 includes a first end 130 and an opposite second end 132. The second space 134 extends through both the first end 130 and the second end 132. The second tube 13 is partly received in the receiving hole 114 of the support member 11 and held in position by a frictional force between the second tube 13 and the receiving hole 114. The second tube 13 can be moved with respect to the support member 11, and thus the height of the nozzle assembly 1 can be easily adjusted when needed.

The nozzle assembly 1 may include a first ring 16 securely connected to the second end 132 of the second tube 13. The first ring 16 defines a first through hole 160 communicating with the second space 134. The diameter of the first through hole 160 is less than that of the second space 134. Therefore, the first ring 16 can centralize the airflow from the second space 134 of the second tube 13.

In a first embodiment as shown in FIGS. 2-3, the nozzle assembly 1 includes a second ring 14 securely connected to the first end 130 of the second tube 13 and the baffling member 15 is a rectangular sheet. The second ring 14 defines a second through hole 140 for fixing the baffling member 15 therein. The diameter of the second through hole 140 is substantially equal to that of the second space 134. The baffling member 15 is received in the second through hole 140 of the second ring 14, and the four corners of the baffling member 15 stay in contact with the ring 14. Thus, the baffling member 15 and the second ring 14 cooperatively define four gaps A therebetween.

Figure 4:
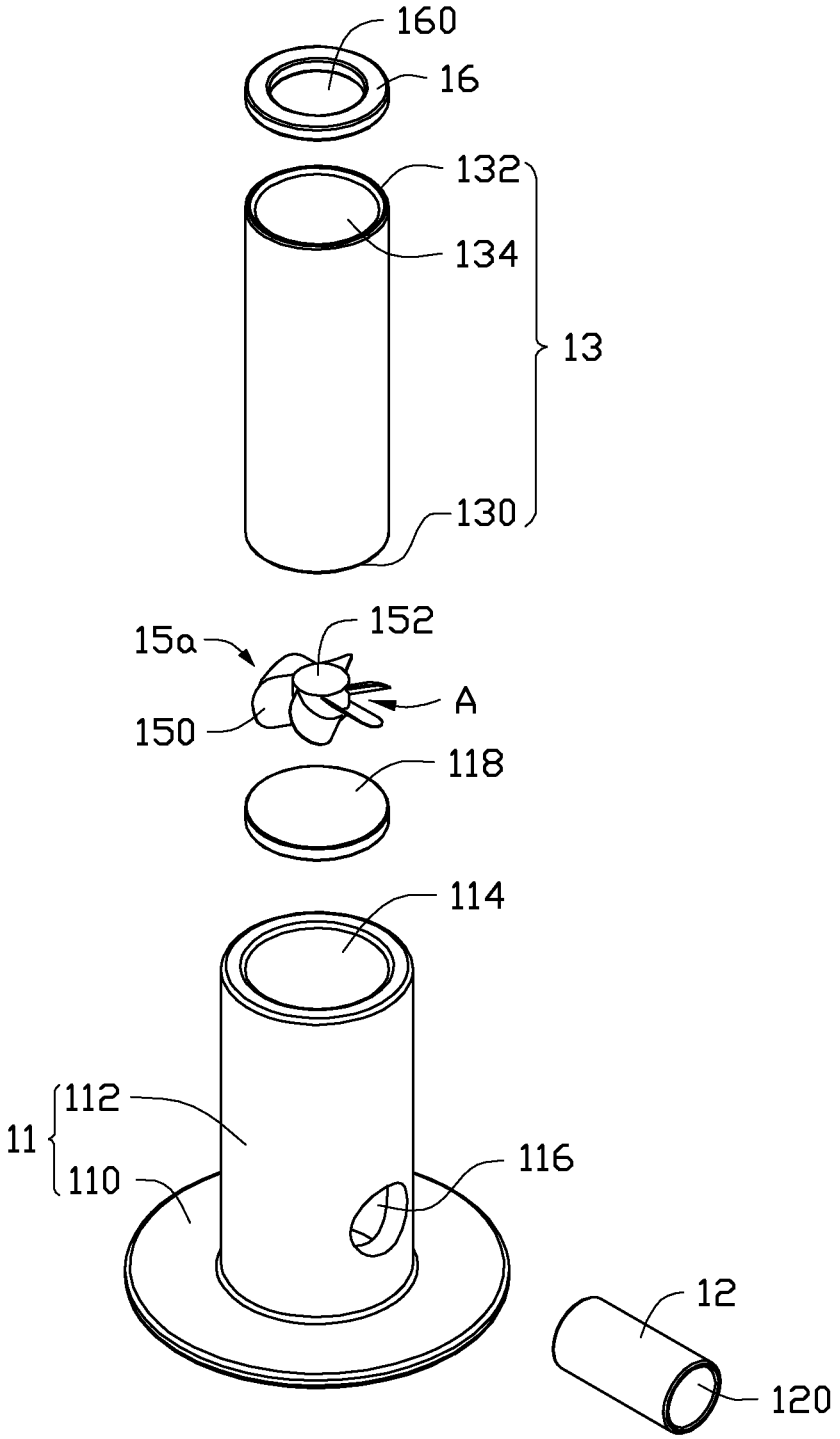
FIG. 4 is an exploded, isometric view of a nozzle assembly according to another embodiment.

Referring also to FIG. 4, in another embodiment, the baffling member 15*a* includes a main body 152 and a number of blades 150 extending radially from the main body 152. A distal end of each blade 150 is fixed to an inner surface of the second tube 13. Each two adjacent blades 150 and an inner surface of the second tube 13 cooperatively define a gap A therebetween.

When in use, the first tube 12 is connected to a source, e.g. an air compressor (not shown). Air flows into the receiving hole 114 of the support member 11 through the first tube 12 and passes through the gaps A and enters into the second tube 13. The obstacles represented by the gaps A result in a uniform airflow without turbulence from the nozzle assembly 1. Further, the first ring 16 can centralize the airflow sprayed from the nozzle assembly 1.

While various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A nozzle assembly comprising:

a support member defining a receiving hole and an opening communicating with the receiving hole;

a first tube extending through the opening and defining a first space communicating with the receiving hole;

a second tube retained within the receiving hole and defining a second space communicating with the receiving hole;

a baffling member securely connected to an end of the second tube that is retained within the receiving hole, the baffling member forming a plurality of gaps for directing the airflow from the first space; and a ring defining a through hole and connected to the second tube, wherein the baffling member is a rectangular sheet securely retained within the through hole, with four corners thereof staying in contact with the ring, which forms the plurality of gaps between the ring and the rectangular sheet.

2. The nozzle assembly as described in claim 1, wherein the support member comprises a base and a tube perpendicular to the base, the tube defines the receiving hole and the opening.

3. The nozzle assembly as described in claim 2, wherein the base is a round plate and the diameter of the base is greater than that of the tube.

4. The nozzle assembly as described in claim 3, wherein the support member further comprises a magnet located at the bottom of the receiving hole, and the magnet is used to apply an attractive force so as to attach the support member to a member.

5. The nozzle assembly as described in claim 1, wherein the second tube comprises a first end and an opposite second end, and the second space extends through both the first end and the second end.

6. The nozzle assembly as described in claim 1, wherein the second tube is partly received in the receiving hole of the support member and held in position by a frictional force between the second tube and the receiving hole.

* * * * *